US010892541B2

(12) United States Patent
Jones

(10) Patent No.: US 10,892,541 B2
(45) Date of Patent: Jan. 12, 2021

(54) SATELLITE ANTENNA HEATING SYSTEM

(71) Applicant: AT&T Intellectual Property I, L.P., Atlanta, GA (US)

(72) Inventor: Todd W. Jones, Kansas City, MO (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 0 days.

(21) Appl. No.: 16/426,493

(22) Filed: May 30, 2019

(65) Prior Publication Data

US 2020/0381798 A1 Dec. 3, 2020

(51) Int. Cl.

| | |
|---|---|
| ***H01Q 1/02*** | (2006.01) |
| ***H01Q 15/16*** | (2006.01) |
| ***H01Q 1/12*** | (2006.01) |
| ***H01Q 15/14*** | (2006.01) |

(52) U.S. Cl.

CPC ..... *H01Q 1/02* (2013.01); *H01Q 1/1278* (2013.01); *H01Q 15/142* (2013.01); *H01Q 15/16* (2013.01)

(58) Field of Classification Search

CPC ..... H01Q 1/02; H01Q 1/1271; H01Q 1/1278; H01Q 19/12; H01Q 15/16; H01Q 15/142; H01Q 15/165

See application file for complete search history.

(56) References Cited

U.S. PATENT DOCUMENTS

| | | | | |
|---|---|---|---|---|
| 5,729,238 | A * | 3/1998 | Walton, Jr. | H01Q 1/02 343/704 |
| 5,798,735 | A * | 8/1998 | Walton, Jr. | H01Q 1/02 343/704 |
| 6,445,349 | B1 * | 9/2002 | Jones | H01O 1/02 343/704 |
| 8,421,690 | B2 * | 4/2013 | Cummings | H01Q 1/02 343/704 |
| 8,659,490 | B2 * | 2/2014 | Walton | H01Q 1/02 343/704 |
| 10,084,226 | B2 * | 9/2018 | Mellas | H01Q 15/16 |
| 2010/0328167 | A1 * | 12/2010 | Stephens | H01Q 1/02 343/704 |
| 2019/0335612 | A1 * | 10/2019 | Simmonds | H05K 7/20272 |

* cited by examiner

*Primary Examiner* — Vibol Tan

(74) *Attorney, Agent, or Firm* — Guntin & Gust, PLC; Dana B. Lemoine

(57) ABSTRACT

A satellite antenna heating system, includes a satellite antenna reflector defining a reflector fluid chamber and that includes a reflector wall. The reflector wall includes a first surface that is located adjacent the reflector fluid chamber, and a second surface that is located opposite the reflector wall from the first surface and provides an outer surface of the satellite antenna reflector, wherein the reflector fluid chamber is configured to channel a fluid through at least a portion of the satellite antenna reflector.

20 Claims, 10 Drawing Sheets

200

SATELLITE ANTENNA HEATING SYSTEM

BACKGROUND

The present disclosure relates generally to satellite antennas, and more particularly to a satellite antenna heating system provided in a satellite antenna reflector.

Many regions of the world experience temperatures that fall below the freezing point of water. As a result, ice and/or snow build up on satellite antenna in these regions. Build-up of ice and/or snow on a reflector of the satellite dish negatively affects a satellite signal (e.g., high frequency RF communication signals) being received and transmitted at the reflector and reflected to a receiver. Some conventional satellite dish heating systems use electrical heat beds and coils embedded in the concentrator or on the back of the concentrator to melt ice/snow. However, the electrical heat beds require conductors that may negatively affect the satellite signal, do not quickly melt precipitation when activated, and are energy inefficient. Other conventional satellite dish heating systems use a gas heater and a blower in front of an antenna canvas system. However, these systems lack consistent heat generation on the reflective surface of the reflector.

Accordingly, it would be desirable to provide an improved satellite antenna heating system.

SUMMARY

According to an embodiment of the present disclosure, a satellite antenna heating system, includes: a satellite antenna reflector that defines a reflector fluid chamber and that includes a reflector wall. The reflector wall includes a first surface that is located adjacent the reflector fluid chamber, and a second surface that is located opposite the reflector wall from the first surface and provides an outer surface of the satellite antenna reflector, such that the reflector fluid chamber is configured to channel a fluid through at least a portion of the satellite antenna reflector.

In other embodiments, the satellite antenna heating system includes a fluid moving system that is coupled to the reflector fluid chamber and that is configured to move the fluid through the reflector fluid chamber. In some embodiments, the fluid moving system is located in the satellite antenna reflector.

In yet other embodiments, the fluid moving system is configured to begin moving fluid through the reflector fluid chamber in response to an atmospheric temperature satisfying a predetermined threshold and the second surface is configured to reflect satellite signals.

In yet other embodiments, the satellite antenna heating system includes a fluid heating system coupled to the fluid moving system. The fluid moving system is configured to move the fluid through the fluid heating system such that fluid output from the fluid heating system has a temperature that is above the freezing point of water. In some embodiments, the fluid heating system includes a geothermal heat exchanger where at least a portion of the geothermal heat exchanger is positioned in a geothermal well that is below a frost line of a subterranean environment to transfer heat from the geothermal well to the fluid.

In yet other embodiments, the satellite antenna heating system includes a plurality of heat transfer members that extend from the reflector wall to provide the first surface of the reflector wall.

In yet other embodiments, the heat is transferred from the fluid in the reflector fluid chamber to the second surface via the first surface and the reflector wall.

In yet other embodiments, the satellite antenna reflector includes a first satellite antenna reflector panel and a second satellite antenna reflector panel coupled to the first satellite antenna reflector panel, and such that a first portion of the reflector fluid chamber is included in the first satellite antenna reflector panel and a second portion of the reflector fluid chamber is included in the second satellite antenna reflector panel. In some embodiments, the first portion of the reflector fluid chamber is configured to couple to the second portion of the reflector fluid chamber.

In yet other embodiments, the reflector fluid chamber includes a fluid channel, which in some embodiments is a serpentine fluid channel.

According to an embodiment of the present disclosure, a satellite antenna reflector panel, includes a reflector wall that is provided on a satellite antenna reflector panel. The reflector wall includes a first surface that is located adjacent at least a portion of a reflector fluid chamber that is defined by the satellite antenna reflector panel, and a second surface that is located opposite the reflector wall from the first surface and that provides at least a portion of an external surface of the satellite antenna reflector panel. The reflector fluid chamber is configured to channel a fluid through at least a portion of the satellite antenna reflector panel. In some embodiments the reflector fluid chamber is configured to couple to an adjacent reflector fluid chamber of an adjacent satellite antenna reflector panel that extends from the reflector wall.

In other embodiments, the satellite antenna reflector panel includes a fluid moving system that is coupled to the reflector fluid chamber and that is configured to move the fluid through the reflector fluid chamber.

According to an embodiment of the present disclosure a method of heating a satellite antenna includes moving, by a fluid moving system, a fluid through a reflector fluid chamber that is located in a satellite antenna reflector that includes a reflector wall, wherein the reflector wall includes: a first surface that is located adjacent the reflector fluid chamber; and a second surface that is located opposite the reflector wall from the first surface and provides an outer surface of the satellite antenna reflector; and transferring heat from the fluid in the reflector fluid chamber to the second surface via the first surface and the reflector wall.

In other embodiments, the method includes transferring, by a fluid heating system coupled to the fluid moving system, heat to the fluid. In some embodiments, the fluid heating system includes a geothermal heat exchanger, such that at least a portion of the geothermal heat exchanger is positioned in a geothermal well that is below a frost line of a subterranean environment to transfer heat from the geothermal well to the fluid.

DETAILED DESCRIPTION

The systems and methods of the present disclosure provide for a satellite antenna heating system that is configured to heat a surface of at least a satellite antenna reflector such that snow and/or ice do not accumulate on the surface of the satellite antenna reflector. As discussed above, snow/ice may attenuate or otherwise interfere with a wireless signal provided by a satellite transceiver and received by the satellite antenna reflector. Conventional satellite heating systems are inefficient and may themselves interfere with the wireless signal provided by the satellite transceiver.

The satellite antenna heating system of the present disclosure addresses these issues by providing a satellite antenna reflector that defines a reflector fluid chamber. The satellite antenna reflector includes a reflector wall that includes a first surface that is located adjacent the reflector fluid chamber, and a second surface that is located opposite the reflector wall from the first surface and provides an outer surface of the satellite antenna reflector. The reflector fluid chamber is configured to channel a fluid through at least a portion of the satellite antenna reflector. A fluid moving system may be coupled to the reflector fluid chamber and may be configured to move a fluid that is heated by a fluid heating system through the reflector fluid chamber. The heat from the fluid may be transferred from the fluid in the reflector fluid chamber to the reflector wall such that the outer surface of the satellite antenna reflector is heated to a temperature that will prevent ice/snow accumulation and/or melt ice/snow accumulation. In various examples, the fluid heating system may include a geothermal heat exchanger that is located below a frost line in a subterranean environment. As such, a more efficient satellite antenna heating system is disclosed that minimizes interference with wireless signals provided by a satellite transceiver and melts and/or prevents accumulation of snow/ice on the satellite antenna reflector.

Figure 1:
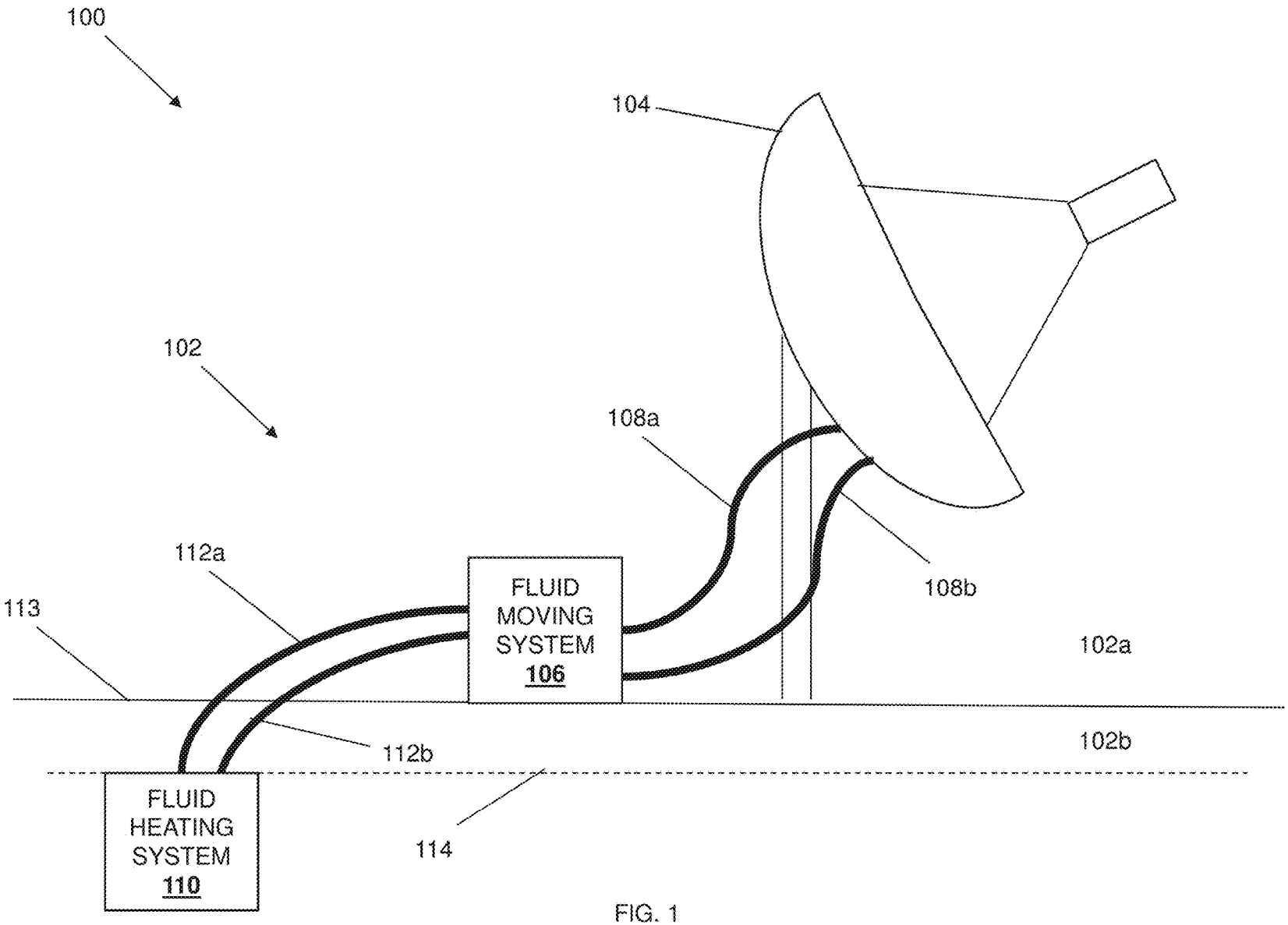
FIG. 1 is a schematic view illustrating an embodiment of a satellite antenna heating system.

Referring to FIG. 1, an embodiment of a satellite antenna heating system 100 is illustrated. In the illustrated embodiment, the satellite antenna heating system 100 is provided in a physical environment 102 that includes one or more sub-environments such as an atmospheric environment 102*a* and a secondary environment 102*b*. The secondary environment 102*b* may be a building, a geological volume (e.g., defined by ground and subterranean matter), a watercraft, an aircraft, a land vehicle, an offshore platform and/or a body of water, although other secondary environments will fall within the scope of the present disclosure. A satellite antenna 104 (e.g. a satellite dish) is positioned in the atmospheric environment 102*a* and may be configured to receive wireless signals provided by a transmitting antenna included on a satellite. For example, the wireless signals may be transmitted in one or more radio frequency (RF) bands, e.g., the microwave L-Band 1-2 GHz, S Band 2-4 GHz, C Band 4-8 GHz, X Band 8-12 GHz, Ku Band 12-18 GHz and Ka 26-40 GHz. The satellite antenna 104 may be a parabolic torus reflector antenna (e.g., a Simulsat™ manufactured by Antenna Technology Communications, Inc, of Chandler, Ariz., USA), a parabolic antenna, or any other antenna for receiving wireless signals from a satellite transceiver that would be apparent to one of skill in the art in possession of the present disclosure.

In the illustrated embodiment, the satellite antenna heating system 100 includes a fluid moving system 106 that is coupled to the satellite antenna 104 via one or more fluid conduits (e.g., a fluid conduit 108*a* and a fluid conduit 108*b*) and that is configured to move fluids (e.g., a gas and/or a liquid (e.g., water, a glycol, an oil) through the one or more fluid conduits 108*a* and/or 108*b*. The fluid moving system 106 may include a fan, a pump, and/or any other fluid moving system that would be apparent to one of skill in the art in possession of the present disclosure. The fluid conduits 108*a* and/or 108*b* may include a tube, a pipe, a hose, and/or any other rigid or flexible conduit that would be apparent to one of skill in the art in possession of the present disclosure. In the illustrated example, the fluid moving system 106 may move fluid through the fluid conduit 108*a* to be received by the satellite antenna 104, and then the fluid may be returned to the fluid moving system 106 through the fluid conduit 108*b* from the satellite antenna 104. However, in other examples, the fluid may not be returned to the fluid moving system 106 and instead be disposed after the fluid. Also, in the illustrated embodiment, the fluid moving system 106 is provide in the atmospheric environment 102*a*. However, the fluid moving system 106 may be included in the satellite antenna 104, the secondary environment 102*b*, and/or any other environment that may be apparent to one of skill in the art in possession of the present disclosure. As such, and as discussed below, when the fluid moving system is located in or on the satellite antenna 104, the fluid conduits 108*a* and 108*b* be omitted because the fluid moving system 106 may be directly coupled to a reflector fluid chamber defined by the satellite antenna 104, as discussed below.

In the illustrated embodiment, the satellite antenna heating system 100 includes a fluid heating system 110 that is coupled to the satellite antenna 104 via one or more fluid conduits (e.g., a fluid conduit 112*a* and a fluid conduit 112*b*). The fluid heating system 110 may be configured to heat a fluid. In the illustrated embodiment, the fluid heating system 110 may be located in the secondary environment 102*b*. The secondary environment 102*b* may be at an ambient temperature that is greater than the ambient temperature of the atmospheric environment 102*a* or the ambient temperature of the secondary environment 102*b* may be greater than the freezing point of water (e.g., 0 degrees Celsius at 1 atm). In the illustrated example, the secondary environment 102*b* may be a subterranean environment below ground 113. As such, the fluid heating system 110 may be positioned below a frost line 114 in a geothermal well and may include a heat exchanger that transfers heat from the subterranean environment to the fluid within the fluid heating system 110. For example, the heat exchanger included in the fluid heating system 110 may include a plurality of heat exchange channels (e.g., pipes, tubing, etc.) that are configured to transfer heat from the secondary environment 102*b* to the fluid within the heat exchange channels. However, while the fluid heating system 110 is located in the secondary environment

102*b* and transfers heat from the secondary environment 102*b* to the fluid within the fluid heating system 110, one of skill in the art will recognize that other fluid heating systems may be contemplated without departing from the scope of the present disclosure. For example, the fluid heating system 110 may include its own heat source (e.g., an electric heater, a gas heater, and/or any other heat source that may be apparent to one of skill in the art in possession of the present disclosure) and use that heat source to heat the fluid in the fluid heating system 110. As such, the fluid heating system 110 may be alternatively located in the atmospheric environment 102*a*, located in the satellite antenna 104, located within the fluid moving system 106 or portions thereof.

Figure 2A:
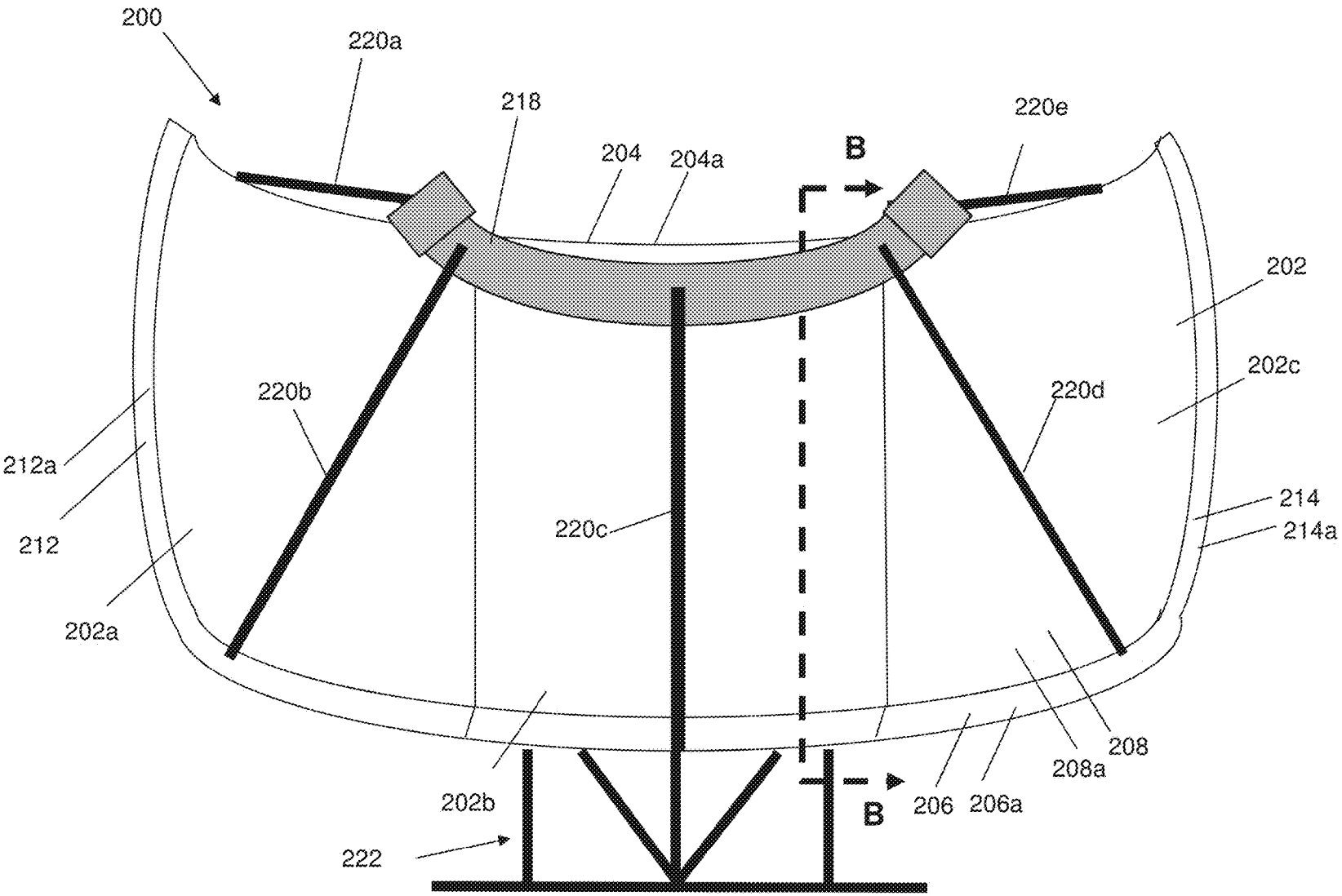
FIG. 2A is a perspective view illustrating an embodiment of a satellite antenna of the satellite antenna heating system of FIG. 1.
Figure 2B:
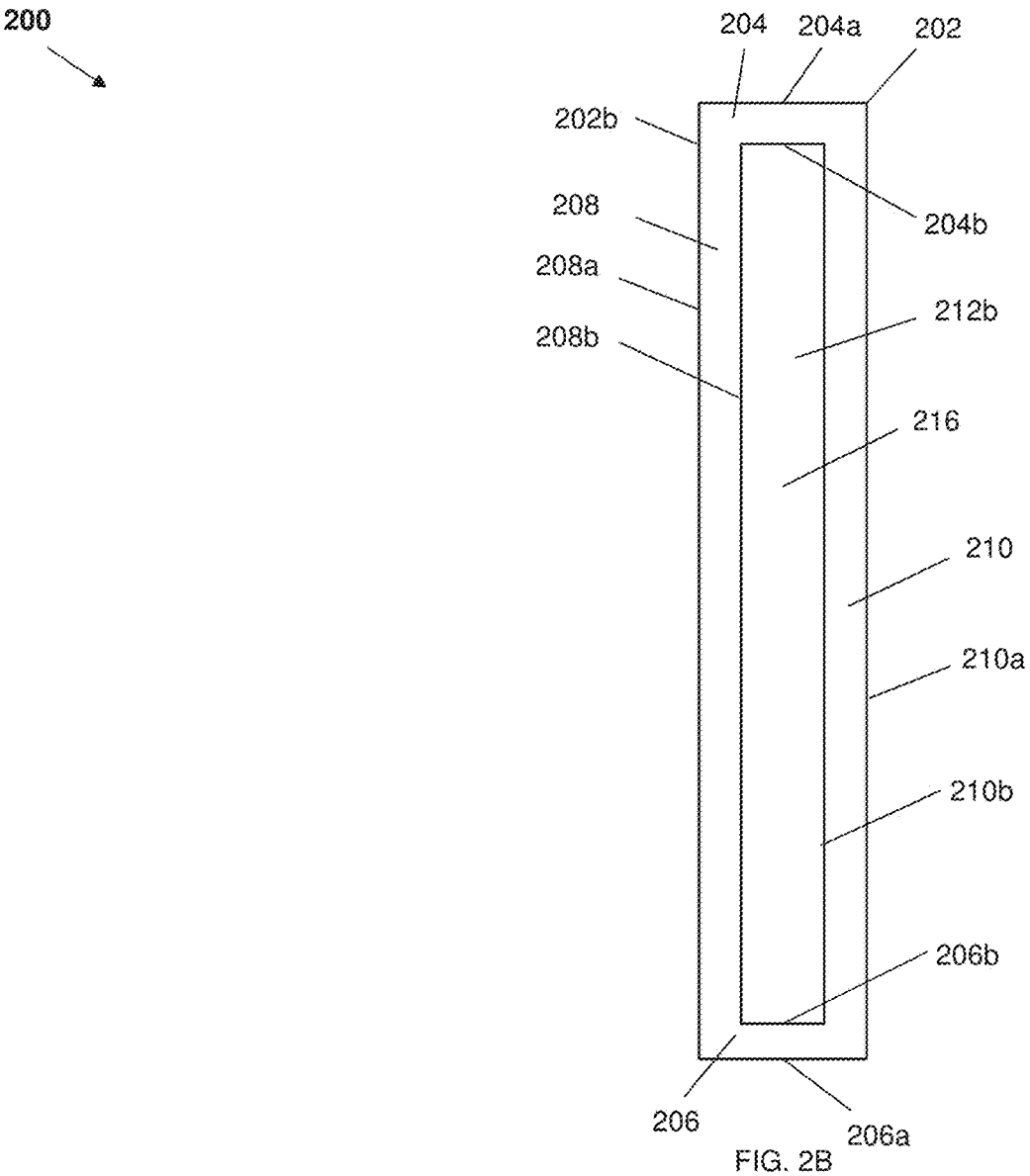
FIG. 2B is a cut-away view along the plane B-B illustrating an embodiment of a satellite antenna reflector of the satellite antenna of FIG. 2A.

Referring now to FIGS. 2A and 2B, an embodiment of a satellite antenna 200 is illustrated. In an embodiment, the satellite antenna 200 may be the satellite antenna 104 discussed above with reference to the satellite antenna 104 in FIG. 1, and as such may include some or all of the components of the satellite antenna 104. In the illustrated embodiment, the satellite antenna 200 is a parabolic torus reflector antenna. However, in other embodiments, the features of the satellite antenna 200 discussed below may be provided for other types of satellite antenna including, for example, a parabolic antenna, and/or other satellite antennas that would be apparent to one of skill in the art in possession of the present disclosure. The satellite antenna 200 includes a satellite antenna reflector 202. The satellite antenna reflector may include one or more satellite antenna reflector panels 202*a*, 202*b*, and/or 202*c*. Each satellite antenna reflector panel 202*a*, 202*b*, and/or 202*c* may have a top wall 204, a bottom wall 206 that is located opposite the satellite antenna reflector 202 from the top wall 204, a front wall 208 extending between the top wall 204 and the bottom wall 206, a rear wall 210 extending between the top wall 204 and the bottom wall 206 and located opposite the satellite antenna reflector 202 from the front wall 208, and a pair of side walls 212 and 214 extending between the top wall 204, the bottom wall 206, the front wall 208, and the rear wall 210 and located opposite the satellite antenna reflector 202 from each other. The top wall 204 provides a top outer surface 204*a* and a top inner surface 204*b* of the satellite antenna reflector 202, the bottom wall 206 provides a bottom outer surface 206*a* and a bottom inner surface 206*b* of the satellite antenna reflector 202, the front wall 208 provides a front outer surface 208*a* and a front inner surface 208*b* located opposite the front wall 208 from the front outer surface 208*a* of the satellite antenna reflector 202, the rear wall 210 provides a rear outer surface 210*a* and a rear inner surface 210*b* of the satellite antenna reflector 202, the side wall 212 provides a side outer surface 212*a* and a side inner surface 212*b* of the satellite antenna reflector 202, and the side wall 214 provides a side outer surface 214*a* and a side inner surface (not illustrated but located opposite the side wall 214 from the side outer surface 214*a*) of the satellite antenna reflector 202. The satellite antenna reflector 202 defines a reflector fluid chamber 216 between the top inner surface 204*b*, the bottom inner surface 206*b*, the front inner surface 208*b*, the rear inner surface 210*b*, the side inner surface 212*b* and the side inner surface of the side wall 214.

In an embodiment, the satellite antenna 200 may include a satellite antenna receiver 218 that is coupled to the satellite antenna reflector 202 via one or more support members (e.g., support members 220*a*, 220*b*, 220*c*, 220*d*, and/or 220*e*). The satellite antenna receiver 218 may be configured to receive the wireless signals provided by the transmitting antenna included in a satellite and that are reflected and concentrated by the satellite antenna reflector 202. The satellite antenna 200 may include a mounting structure 222 that is coupled to the satellite antenna reflector 202 and configured to support the satellite antenna reflector 202 and the satellite antenna receiver 218. While specific structure and components for the satellite antenna 200 are illustrated in FIGS. 2A and 2B and described below, one of skill in the art in possession of the present disclosure will recognize that a wide variety of other structures and components will fall within the scope of the present disclosure.

Figure 3A:
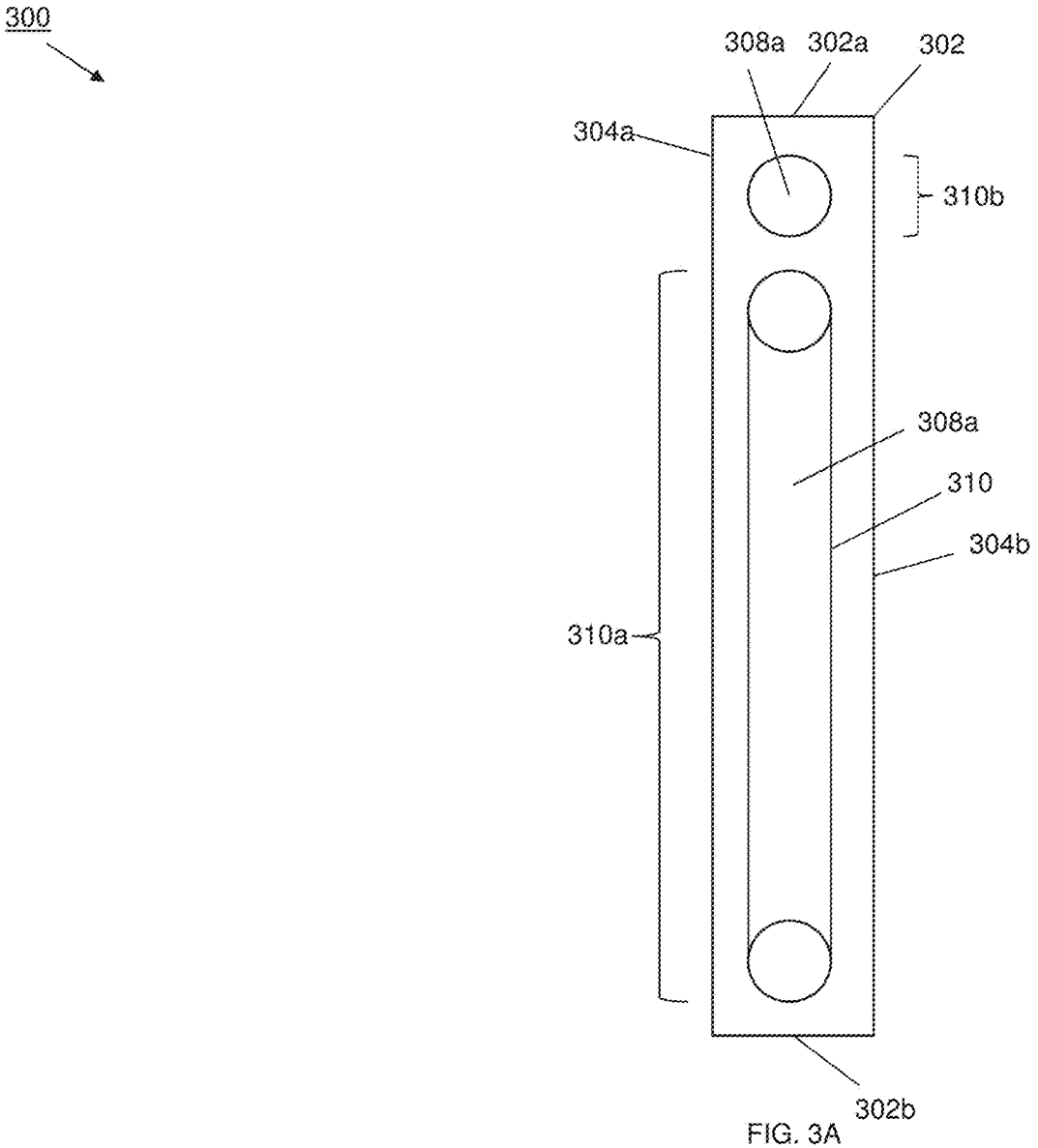
FIG. 3A is a cut-away view illustrating an embodiment of a satellite antenna reflector panel that may be provided with the satellite antenna of FIGS. 2A and 2B.
Figure 3B:
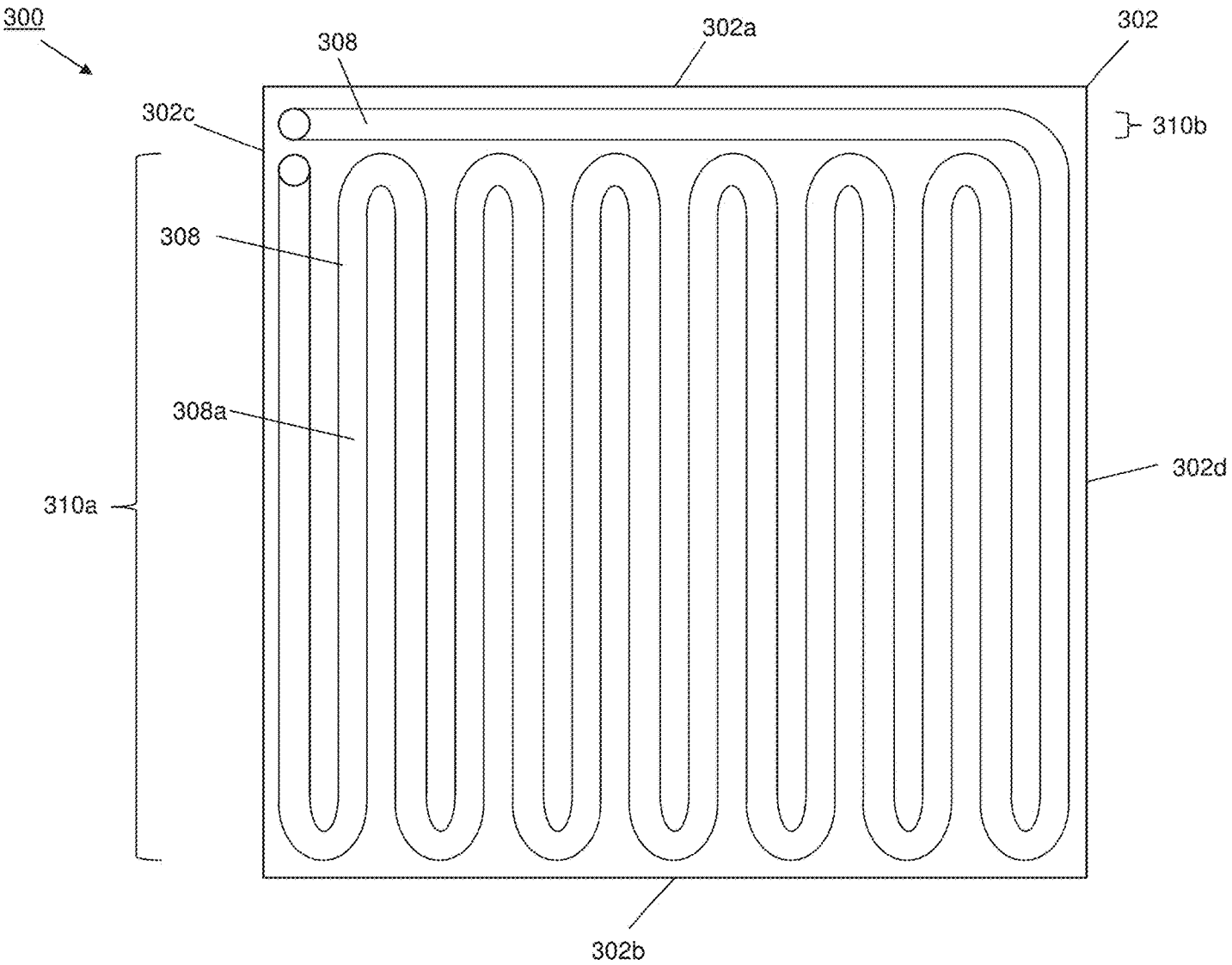
FIG. 3B is a cut-away view illustrating an embodiment of the satellite antenna reflector panel of FIG. 3A.

Referring now to FIGS. 3A and 3B, an embodiment of a satellite antenna reflector panel 300 is illustrated. In the embodiments discussed below, the satellite antenna reflector panel 300 is described as being the satellite antenna reflector panel 202*b* of the satellite antenna reflector 202 discussed above with reference to FIGS. 2A and 2B. However, the teachings of the satellite antenna reflector panel 300 may be incorporated into any of the satellite antenna reflector panels 202*a* and up to 202*c* of the satellite antenna reflector 202 while remaining within the scope of the present disclosure. The satellite antenna reflector panel 300 includes a base 302 having a top edge 302*a* that may be the top outer surface 204*a*, a bottom edge 302*b* located opposite the base 302 from the top edge 302*a* that may be the bottom outer surface 206*a*, a side edge 302*c* that may be the side outer surface 212*a* extending between the top edge 302*a* and the bottom edge 302*b*, and a side edge 302*d* that may be the side outer surface 214*a* extending between the top edge 302*a* and the bottom edge 302*b* and located opposite the base 302 from the side edge 302*c*. An outer surface 304*a* (which may be the front outer surface 208*a* of the satellite antenna reflector 202) of the base 302 extends between the top edge 302*a*, the bottom edge 302*b*, the side edge 302*c*, and the side edge 302*d*. An outer surface 304*b* (which may be the rear outer surface 210*a* of the satellite antenna reflector 202) of the base 302 extends between the top edge 302*a*, the bottom edge 302*b*, the side edge 302*c*, and the side edge 302*d* and is located opposite the base 302 from the outer surface 304*a*. In the illustrated embodiment, the base 302 defines a reflector fluid chamber 308, which, in the illustrated embodiment, includes a fluid channel 308*a* between the top edge 302*a*, the bottom edge 302*b*, the side edge 302*c*, the side edge 302*d*, and the outer surfaces 304*a* and 304*b*. However, as discussed below, the fluid channel 308*a* may extend through any of the edges on the satellite antenna reflector panel 300 to couple to other fluid channels defined by other satellite antenna reflector panels in the satellite antenna reflector 202. In different embodiments, the base 302 of the satellite antenna reflector panel 300 may be fabricated from a composite fiberglass material, an Acrylonitrile Butadiene Styrene (ABS) material, a polycarbonate material, a carbon fiber material, combinations thereof, and/or a variety of other non-ferrous materials that would be apparent to one of skill in the art in possession of the present disclosure. Furthermore, a variety of attachment and/or coupling features may be provided on the base 302 of the satellite antenna reflector panel 300 and used to couple the satellite antenna reflector panel 300 to the satellite antenna 200 while remaining within the scope of the present disclosure. In various embodiments, the fluid channel 308*a* may be defined by the satellite antenna reflector panel 300. However, in other embodiments, the fluid channel 308*a* may include tubing, hoses, and/or other fluid transport conduits that are housed within the reflector fluid chamber 308

In the embodiment illustrated in FIGS. 3A and 3B, the fluid channel 308*a* provides a substantially uniform fluid channel that is distributed throughout the satellite antenna reflector panel 300 and that includes a heating section 310*a* and a return section 310*b*. As would be understood by one of skill in the art in possession of the present disclosure, and as discussed in further detail below, a fluid may be moved by a fluid moving system (e.g., the fluid moving system 106) through the heating section 310*a* of the fluid channel 308*a* to dissipate heat from the fluid to the satellite antenna reflector panel 300, and then may be returned to the fluid moving system through the return section 310*b* of the fluid channel 308*a* (while still transferring heat from the fluid in the fluid channel 308*a* to the satellite antenna reflector panel 300). However, while the fluid channel 308*a* is illustrated and described as a substantially uniform fluid channel distributed across the entire satellite antenna reflector panel 300 (e.g., a serpentine fluid channel), other configurations of the fluid channel are envisioned as falling within the scope of the present disclosure. Furthermore, the fluid channel 308*a* in the satellite antenna reflector panel 300 may have a variety of other configurations known in the art while remaining within the scope of the present disclosure. For example, fluid may enter the fluid channel 308*a* in the chassis wall along the top edge 302*a* (e.g., distributed across the length of the top edge), may move through the chassis wall via the force of gravity, may exit the fluid channel 308*a* in satellite antenna reflector panel 300 along the bottom edge 302*b* (e.g., distributed across the length of the bottom edge), and may then be circulated back up to the top edge 302*a* of the satellite antenna reflector panel 300 to repeat the process.

Figure 4:
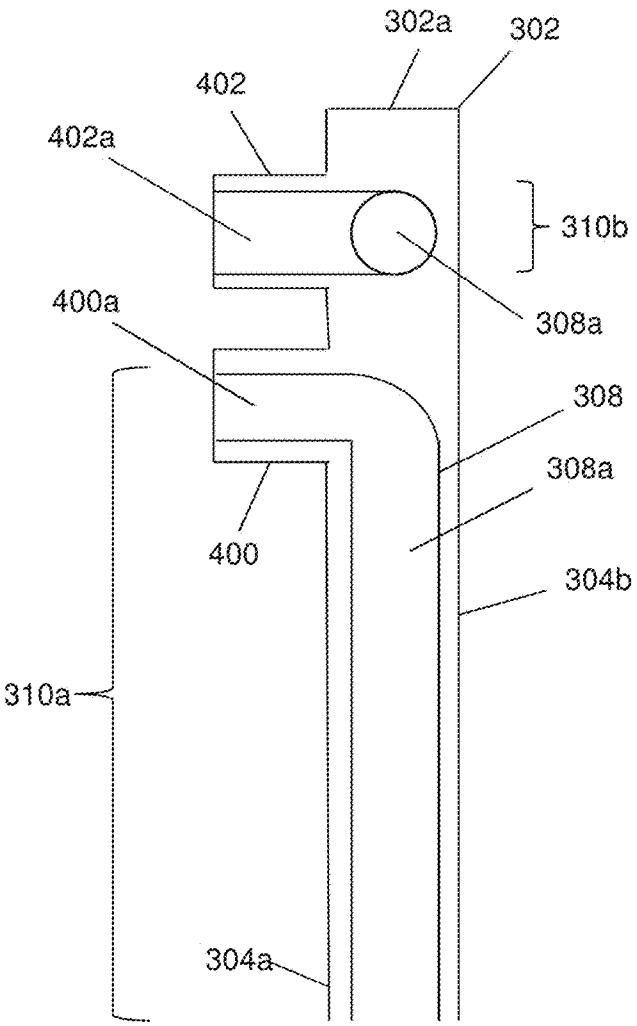
FIG. 4 is a cut-away view illustrating an embodiment of the satellite antenna reflector panel of FIGS. 3A and 3B.

Referring now to FIG. 4, an embodiment of the satellite antenna reflector panel 300 of FIG. 3 is illustrated. In the illustrated embodiment, the satellite antenna reflector panel 300 includes an inlet 400 that extends from the outer surface 304*a* of the satellite antenna reflector panel 300 and defines an inlet channel 400*a* that extends from the heating section 310*a* of the reflector fluid chamber 308. The satellite antenna reflector panel 300 also includes an outlet 402 that extends from the inner surface 306 of the satellite antenna reflector panel 300 spaced apart from and adjacent to the inlet 400, and defines an outlet channel 402*a* that extends from the return section 310*b* of the fluid channel 308*a*. While the terms "inlet", "outlet", "supply" and "return" have been used above, one of skill in the art in possession of the present disclosure will recognize the flow of the fluid through the fluid channel 308*a* may be reversed such that the use of those terms is reversed as well (i.e., the "outlet" becomes the "inlet", and the "inlet" becomes the "outlet", the "return" section becomes the "supply section", and so on). As discussed below, the inlet 400 and the outlet 402 may be coupled to a fluid moving system (e.g., the fluid moving system 106) via the fluid conduits 108*a* and/or 108*b* in order to provide for the movement of fluid through the fluid channel 308*a*. While a specific location of the inlet 400 and the outlet 402 is illustrated and described in FIG. 4 (i.e., adjacent each other and the top edge 302*a* of the satellite antenna reflector panel 300), the inlet 400 and the outlet 402 may extend from any location on the outer surface 304*a* and/or the outer surface 304*b* of the satellite antenna reflector panel 300 and at different distances from each other while remaining within the scope of the present disclosure.

Figure 5:
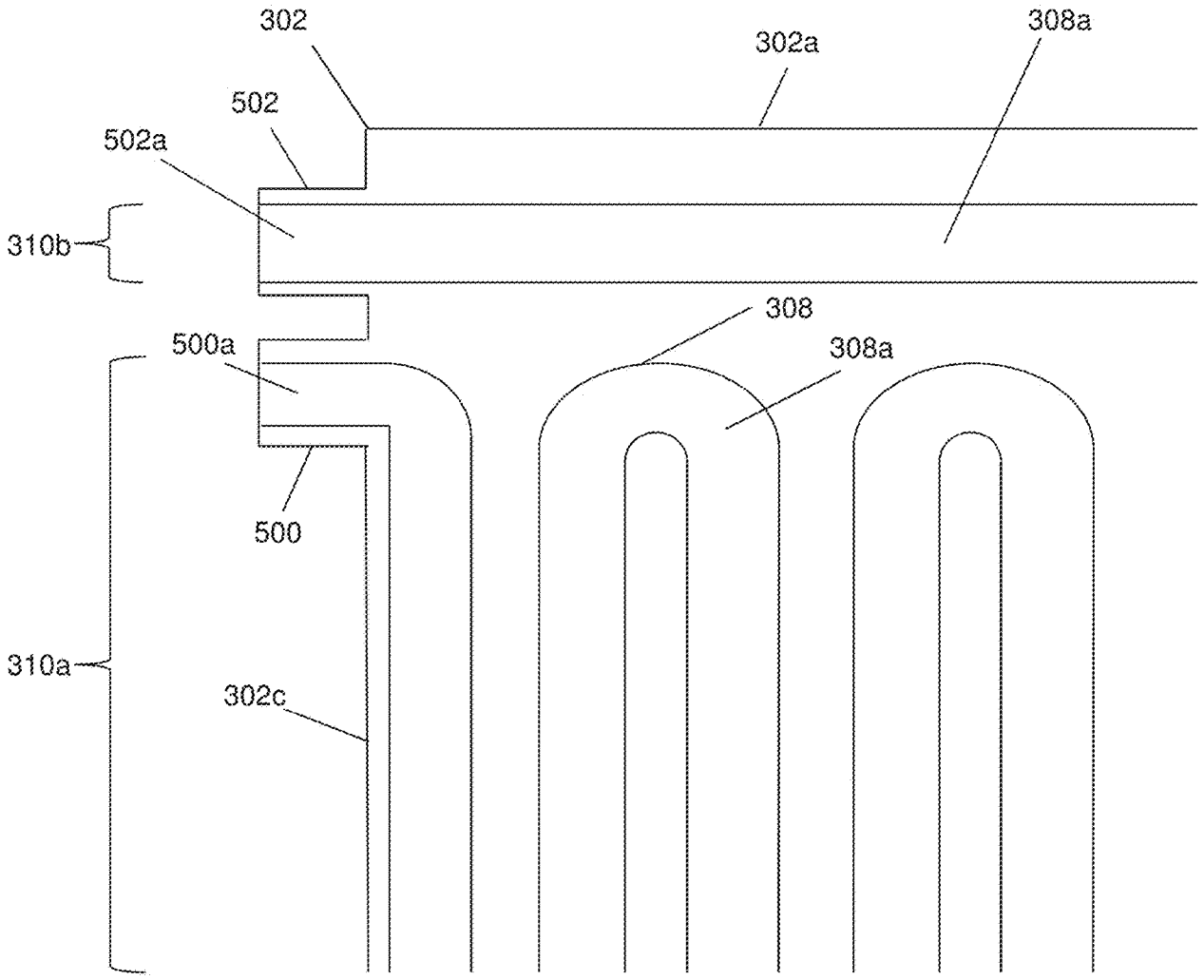
FIG. 5 is a cut-away view illustrating an embodiment of the satellite antenna reflector panel of FIGS. 3A and 3B.

Referring now to FIG. 5, an embodiment of the satellite antenna reflector panel 300 of FIG. 3 is illustrated. In the illustrated embodiment, the satellite antenna reflector panel 300 includes an inlet 500 that extends from the side edge 302*c* of the satellite antenna reflector panel 300 and defines an inlet channel 500*a* that extends from the heating section 310*a* of the fluid channel 308*a*. The satellite antenna reflector panel 300 also includes an outlet 502 that extends from the side edge 302*c* of the satellite antenna reflector panel 300 spaced apart form and adjacent to the inlet 500, and defines an outlet channel 502*a* that extends from the return section 310*b* of the fluid channel 308*a*. Similarly as discussed above, while the terms "inlet", "outlet", "supply" and "return" have been used above, one of skill in the art in possession of the present disclosure will recognize the flow of the fluid through the fluid channel 308*a* may be reversed such that the use of those terms is reversed as well (i.e., the "outlet" becomes the "inlet", and the "inlet" becomes the "outlet", the "return" section becomes the "supply section", and so on). As discussed below, the inlet 500 and the outlet 502 may be coupled to another the satellite antenna reflector panel on the satellite antenna reflector 202 (e.g., that includes a reflector fluid chamber similar to the reflector fluid chamber 308), and/or to a fluid moving system (e.g., the fluid moving system 106) that is located in the reflector fluid chamber 216 of the other reflector fluid chamber in order to provide for the movement of fluid through the reflector fluid chamber 308. While a specific location of the inlet 500 and the outlet 502 is illustrated and described in FIG. 5 (i.e., adjacent each other and the top edge 302*a* of the satellite antenna reflector panel 300), the inlet 500 and the outlet 502 may extend from any location on the side edge 302*c* (and in other embodiments, from the top edge 302*a*, the bottom edge 302*b*, and/or the side edge 302*d*) of the satellite antenna reflector panel 300 and at different distances from each other while remaining within the scope of the present disclosure.

Figure 6:
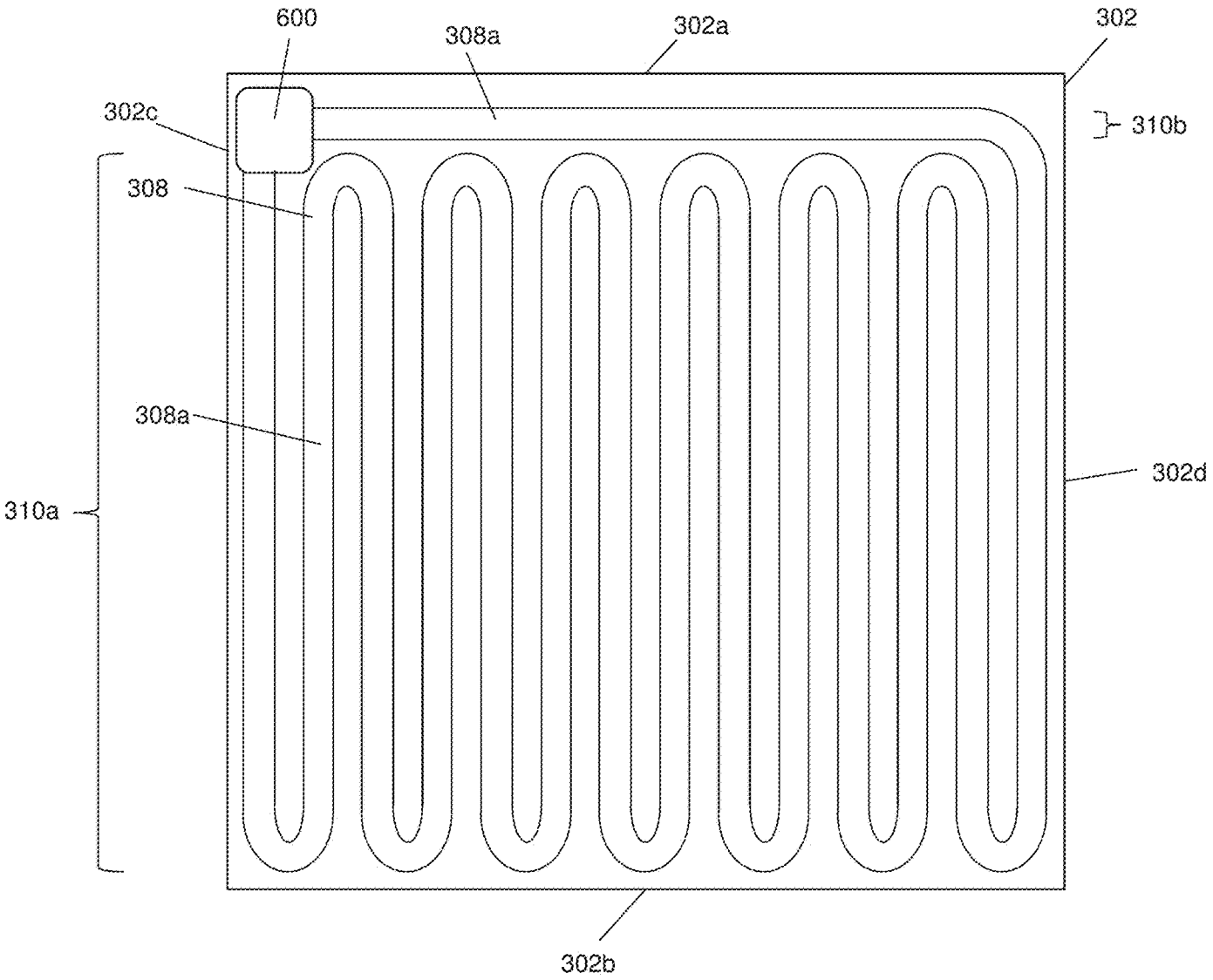
FIG. 6 is a cut-away view illustrating an embodiment of the satellite antenna reflector panel of FIGS. 3A and 3B.
Figure 7:
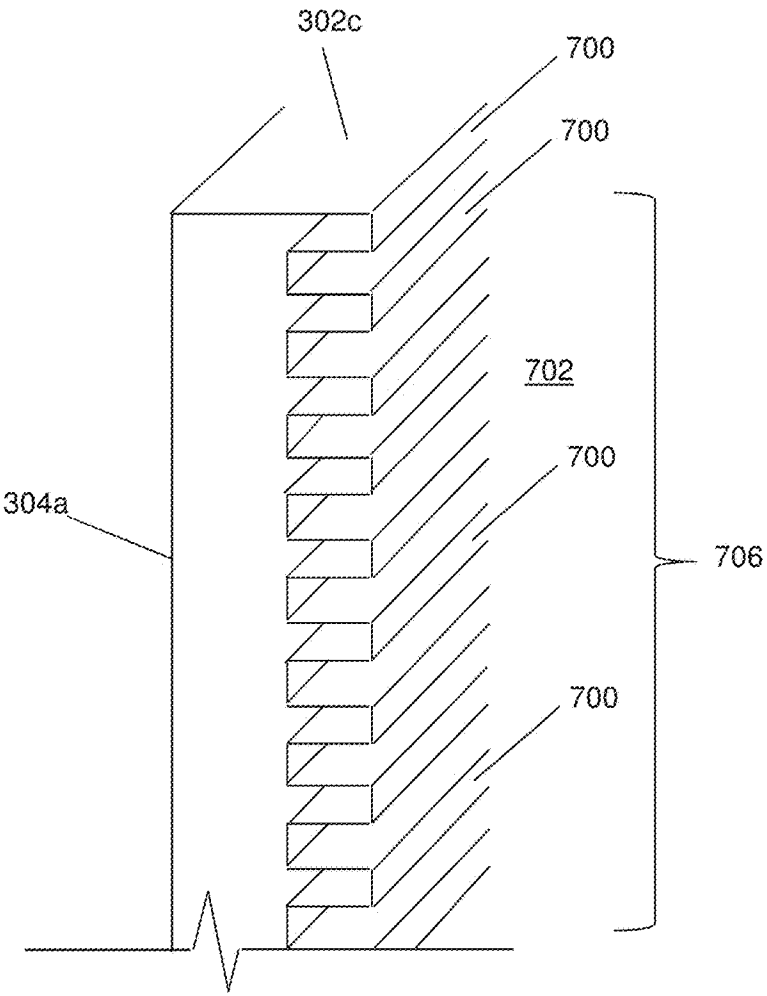
FIG. 7 is a cut-away view illustrating an embodiment of the satellite antenna reflector panel of FIGS. 3A and 3B.

Referring now to FIG. 6, an embodiment of the satellite antenna reflector panel 300 of FIG. 3 is illustrated. In the illustrated embodiment, the satellite antenna reflector panel 300 includes a fluid moving system 600. In an embodiment, the fluid moving system 600 may be the fluid moving system 106 discussed above with reference to the fluid moving system 106 in FIG. 1, and as such may include some or all of the components of the fluid moving system 106. In the illustrated embodiment, the fluid moving system 600 is included on the satellite antenna reflector panel 300 and coupled to the heating section 310*a* of the fluid channel 308*a* and the return section 310*b* of the fluid channel 308*a*. In different embodiments, the fluid moving system 600 may include a pump, a fluid reservoir, the fluid heating system 110, and/or other fluid moving components that would be apparent to one of skill in the art in possession of the present disclosure. In some embodiments, the fluid moving system 600 may be provided within the satellite antenna reflector panel 300 (e.g., between the outer surfaces 304*a* and 304*b* of the satellite antenna reflector panel 300), while in other embodiments, the fluid moving system 600 may extend from the outer surface 304 and/or the inner surface 306 of the satellite antenna reflector panel 300. Thus, in some embodiments, the satellite antenna reflector panel 300 may provide a closed fluid loop that includes a fluid moving system 106 coupled to the fluid channel 308*a*, a fluid included in the fluid channel, the fluid heating system 116 and in some cases a fluid reservoir. However, in other embodiments, the satellite antenna reflector panel 300 may include only one of the fluid moving system 106, the fluid heating system 110, and the fluid reservoir, and may couple to a fluid reservoir, the fluid heating system 110, or the fluid moving system 106, that is located in the satellite antenna reflector panel 300 or outside the satellite antenna reflector panel 300. As discussed below, the satellite antenna reflector panel 300 illustrated in FIG. 6 may be an example of a modular satellite antenna reflector panel that may be coupled to other satellite antenna reflector panels 202*a*, 202*b*, and/or up to 202*c* of the satellite antenna 200, and as such may include a variety of attachment and/or coupling features to couple the satellite antenna reflector panels 300 to the satellite antenna 200 (e.g., such that it engages the side wall 212 or 214 as discussed below) while remaining within the scope of the present disclosure Referring now to FIG. 7, an embodiment of the satellite antenna reflector panel 300 of FIG. 3 is illustrated. In the embodiments of the satellite antenna reflector panel 300 illustrated and discussed above, the outer surface 304*a* and an inner surface 706 of the satellite antenna reflector panel 300 are illustrated as substantially smooth, flat surfaces. However, modifications to those surfaces may be provided to enhance heat transfer to and/or from the satellite antenna reflector panel 300. In the embodiment illustrated in FIG. 7, the satellite antenna reflector panel 300 includes a plurality of heat transfer members 700 that extend from the satellite antenna reflector panel 300 to provide the inner surface 706. For example, the heat transfer members 700 may be provided by a plurality of fins separated from each other by a spacing (e.g., 1 mm, 5 mm, 10 mm, 20 mm or any other spacing that would be apparent to one of skill in the art in possession of the present disclosure). However, different heat transfer member structures, sizes, and spacing will fall within the scope of the present disclosure as well. In the illustrated embodiment, a reflector fluid chamber 702 replaces the reflector fluid chamber 308 and is defined by the inner surface 706 of the satellite antenna reflector panel 300 provided by the heat transfer members 700. In other words, the embodiment illustrated in FIG. 7 provides an example of a "hollow" reflector fluid chamber (e.g., the reflector fluid chamber 216) that is configured to allow fluid to move through the reflector fluid chamber 702 that is provided by a hollow cavity defined by the inner surface 706 rather than a routed channel such as the fluid channel 308*a* discussed above. Such hollow reflector fluid chamber 702 embodiments may be provided using the polymer and polymer-based materials discussed above. However, in other embodiments, the fluid channel 308*a* may be provided in the reflector fluid chamber 702 illustrated in FIG. 7.

Figure 8:
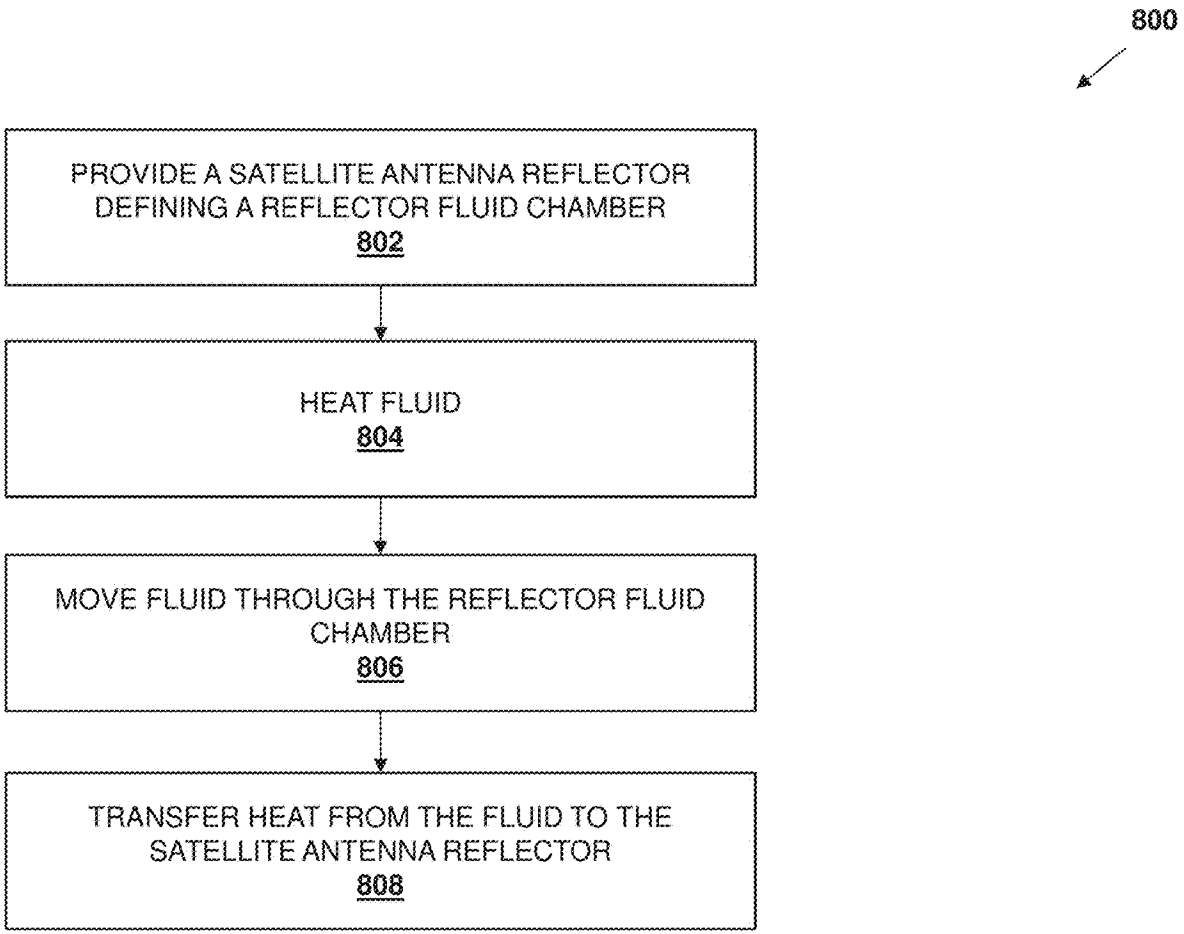
FIG. 8 is a flow chart illustrating an embodiment of a method for satellite antenna heating using a reflector fluid chamber.

Referring now to FIG. 8, and embodiment of a method 800 for providing heat to a satellite antenna reflector using a reflector fluid chamber is illustrated. As discussed below, the method 800 provides the transfer of heat from a fluid provided in a reflector fluid chamber to a reflector wall included on the satellite antenna reflector to melt winter precipitation (e.g., snow and/or ice) accumulated on the satellite antenna reflector panel. The movement of that heated fluid through of the reflector fluid chamber of the satellite antenna reflector utilizes a previously unused, large volume and surface area that provides for the transfer of heat from the fluid such that the heat is ejected from the fluid to the ambient air via the reflector walls of the satellite antenna reflector, which results in the heating of the reflector walls to a temperature that prevents the formation/accumulation of ice and/or snow on the outer surface of the reflector walls and/or melts accumulated ice and/or snow and that fluid may again be circulated through the reflector fluid chamber to continuously transfer heat from a fluid heating system to the fluid and transfer heat from the fluid in the reflector fluid chamber to the ambient air outside the satellite antenna reflector via the reflector walls. As will be appreciated by one of skill in the art in possession of the present disclosure, the use of a reflector fluid chamber within the satellite antenna reflector to heat the satellite antenna reflector provides for substantial increases in the ability to heat the satellite antenna reflector relative to conventional satellite antenna heating systems and minimize signal attenuation at the satellite antenna reflector.

The method 800 begins at block 802 where a satellite antenna reflector defining a reflector fluid chamber is provided. In different embodiments, the provisioning of the satellite antenna reflector that defines the reflector fluid chamber may be performed in a variety of different ways. While a few of those embodiments are illustrated and discussed below, one of skill in the art in possession of the present disclosure will recognize that different combinations and configurations of the satellite antenna reflector other than those specifically illustrated and described below will fall within the scope of the present disclosure. Referring to FIGS. 1-7 illustrated embodiment, the satellite antenna 104 includes the features of the satellite antenna reflector panels 202*a*/300, and specifically has the inlet 400 and the outlet 402 discussed above with reference to FIG. 4 coupled to a fluid moving system 106 that is located in the atmospheric environment 102*a*. In different embodiments, the fluid moving system 106 may include a pump, a fan, a fluid reservoir, and/or other fluid moving components that would be apparent to one of skill in the art in possession of the present disclosure. The satellite antenna heating system 100 provides an example of a satellite antenna 200 with a satellite antenna reflector 202 that defines a reflector fluid chamber (e.g., the reflector fluid chambers 216 and 308 discussed above) that is coupled to a fluid moving system 106 that is separate from the satellite antenna reflector 202 and provided in the atmospheric environment 102*a*, in the illustrated embodiment. However, at least a portion the fluid moving system 106 may be located in the secondary environment 102*b*, and/or the satellite antenna reflector 202 as well or in the alternative.

A fluid may be provided in the fluid moving system 106 and the reflector fluid chamber 216/308 in the satellite antenna reflector panel 202*b*/300 to provide a closed loop reflector heating system. However, in other embodiments, the fluid moving system 106 may move fluid from a fluid source and through the reflector fluid chamber 216/308 such that the fluid exits the satellite antenna 200 into the physical environment 102 and provides an open reflector heating system. In the embodiment illustrated in FIG. 1, the fluid heating system 110 may be provided in the secondary environment 102*b* such as below the frost line 114 in a geothermal well and may include a heat exchanger that transfers heat from the subterranean environment to the fluid provided in the fluid heating system 110. However, in other embodiments at least a portion of the fluid heating system 110 may be provided in the atmospheric environment 102*a*, the satellite antenna 104, the fluid moving system 106 and include a heat source to heat the fluid that is in the fluid heating system 110. As discussed above, while a few specific examples of satellite antenna heating systems are illustrated, a wide variety of different feature combinations and variations may be provided while remaining within the scope of the present disclosure. As such, the present disclosure should not be limited to the specific embodiments illustrated and described herein, as any of the features discussed above may be provided with other features discussed above to provide particular benefits for a given system that will optimize the fluid heating of that system while remaining within the scope of the present disclosure.

The method 800 then proceeds to block 804 where fluid is heated. In an embodiment, at block 804 and with reference to FIGS. 1-7, the fluid heating system 110 may be operated to produce varying levels of heat and/or transfer heat from a heat source (e.g., a secondary environment 102*b*). The fluid heating system 110 may heat the fluid to a temperature that is at least above the freezing point of water for the given atmospheric environment (e.g., 0 degrees Celsius at 1 atm). For example, the temperature of the secondary environment 102*b* below the frost line 114 may be above 0 degrees Celsius and the secondary environment 102*b*, via the fluid heating system 110, may heat the fluid such that the temperature of the fluid is above the freezing point of water. In some embodiments, the heating of the fluid may be performed whenever the satellite antenna 104 is operating. However, in other embodiments, the fluid heating system 110 may be triggered to heat the fluid at block 804. For example, one or more predetermined temperatures (e.g., of specific components, an average of a group of components, of a sensor in the reflector fluid chamber 216/308, the atmospheric environment 102*a*, a surface of the satellite antenna reflector 202, and/or any of the fluid or other components in the satellite antenna heating system 100) may be determined and used to activate the fluid heating system 110 (e.g., via temperature sensors and a controller that includes a processor that activates the fluid heating system 110) such that the fluid is heated when a component, a group of components, the reflector fluid chamber 216/308, or some other system feature reaches the predetermined temperature that is indicative of a need for fluid heating. In other examples, the heating of the fluid in the fluid heating system 110 may be triggered when a satellite signal received at the satellite antenna receiver 218 deteriorates to a predetermined signal strength threshold. In yet other embodiments, the fluid may be heated by the fluid heating system 110 even when the satellite antenna 104 is not operating. For example, when the fluid heating system 110 includes transferring heat from the secondary environment 102*b*, the fluid in the fluid heating system 110 may be maintained at about the temperature of the secondary environment 102*b*.

The method 800 then proceeds to block 806 where fluid is moved through the reflector fluid chamber. In an embodiment, at block 806, the fluid moving system 106 may operate (e.g., via a pump and/or fan in the fluid moving system 106) to move the fluid from the fluid heating system 110 through the reflector fluid chamber 216/308 included in the satellite antenna reflector 202. As such, in some embodiments, the fluid from the fluid heating system 110 may be circulated through the reflector fluid chamber 216/308. As such, the fluid may be moved through the heating section 310*a* and a return section 310*b* of the fluid channel 308*a* in the satellite antenna reflector panel 300 illustrated in FIG. 3B. As discussed above, in some embodiments, the fluid moving system 106 may circulate the fluid only through the satellite antenna reflector panel 202*b*. However, in other embodiments, the fluid moving system 106 may circulate the fluid through a plurality of the satellite antenna reflector panels 202*a*, 202*b*, and/or up to 202*c*. Furthermore, in some embodiments, the fluid circulated through the reflector fluid chamber 216/308 may be further circulated through fluid conduits that extend into adjacent components of the satellite antenna 200 such as the satellite antenna receiver 218 and/or the mounting structure 222.

In some embodiments, the movement of the fluid through the satellite reflector fluid chamber 216/308 may be performed whenever the satellite antenna 104 is operating. However, in other embodiments, the fluid moving system 106 may be triggered to move the fluid through the reflector fluid chamber 216/308 at block 806. For example, one or more predetermined temperatures (e.g., of specific components, an average of a group of components, of a sensor in the reflector fluid chamber 216/308, the atmospheric environment 102*a*, a surface of the satellite antenna reflector 202, and/or any of the fluid or other components in the satellite antenna heating system 100) may be determined and used to activate the fluid moving system 106 (e.g., via temperature sensors and a controller that includes a processor that activates the fluid moving system 106) such that the fluid is moved through the reflector fluid chamber 216/308 when a component, a group of components, the reflector fluid chamber 216/308, or some other system feature reaches the predetermined temperature that is indicative of a need for fluid heating. In other examples, the movement of the fluid by the fluid moving system 106 may be triggered when a satellite signal received at the satellite antenna receiver 218 deteriorates to a predetermined signal strength threshold.

The method 800 then proceeds to block 808 where the heat in the fluid is transferred from the fluid to the satellite antenna reflector. In an embodiment, as the fluid moves through the reflector fluid chamber 216/308 in the satellite antenna reflector panel 206*b*/300, the heat produced by the fluid heating system that is transferred to the fluid is then transferred, via the satellite antenna reflector panel 300, to the ambient air adjacent the outer surfaces 304*a*/304*b* (e.g., the front outer surface 208*a* of the satellite antenna reflector 202). For example, the fluid in the satellite antenna heating system 100 may move through fluid heating system 110, the fluid may move through the fluid conduits 112*a* and 106*a* into the reflector fluid chamber 216/308 included in the satellite antenna reflector 202 and the heat in the fluid is transferred through at least the front wall 208 of satellite antenna reflector 202 and to the ambient air in the atmospheric environment 102*a*; however, the heat in the fluid may be transferred through any of the walls 204, 206, 208, 210, 212, and/or 214 of the satellite antenna reflector 202. That heated fluid will then continue to move through the reflector fluid chamber 216/308 in the satellite antenna reflector 202 and, as it does, heat will be transferred from the fluid and through the satellite antenna reflector 202, via at least the front wall 208 of the satellite antenna reflector 202, to the ambient air adjacent the front outer surface 208*a*/outer surface 304*a* of the satellite antenna reflector 202. Doing so heats front outer surface 208*a*/the outer surface 304*a* of the satellite antenna reflector 202, which melts snow and/or ice and/or prevents snow and/or ice from accumulating on the outer surface 304 of the satellite antenna reflector 202. The fluid may then return to the fluid heating system 110 via the fluid conduits 106*b* and 112*b*.

In some embodiments, the heat transfer members 700 illustrated in FIG. 7 may be utilized on the satellite antenna reflector to provide the heat transfer at block 808. For example, the heat transfer members 700 that provide the inner surface 306 of the satellite antenna reflector panel 300 in FIG. 7 may be utilized to transfer heat from heated fluid provided to the satellite antenna reflector 202 and to the ambient air in the atmospheric environment 102*a*.

Thus, system and methods have been described that provide for the use of a reflector fluid chamber in a satellite antenna reflector to transfer heat to a fluid and moving the fluid through the reflector fluid chamber to transfer heat from the fluid to the satellite antenna reflector. The fluid in the reflector fluid chamber may operate in conjunction with fluid moving systems, fluid conduits, heat transfer members extending from the satellite antenna reflector, a fluid heating system and/or other heat transfer subsystems to transfer the heat produced by the fluid heating system to the fluid, while pumps, fluid reservoirs, and/or other reflector heating subsystems may be utilized to move that fluid through the reflector fluid chamber such that the heat may be transferred from the fluid through the satellite antenna reflector. In some embodiments, the fluid may be heated using a geothermal heat source when at least a portion of the fluid heating system is below a frost line. The use of the reflector fluid chamber to transfer heat from fluid in the reflector fluid chamber to the satellite antenna reflector provides for the use of large and previously unutilized and undervalued volume within a satellite antenna reflector to transfer heat to the surfaces of the satellite antenna reflector to melt snow and/or ice relative to conventional satellite heating systems that blow warm air on the surface of the satellite antenna reflector or use electrical heating systems that attach to satellite antenna reflector. As such, utilization of the reflector fluid chamber defined by the satellite antenna reflector of the present disclosure may melt snow and/or ice with little or no attenuation to the wireless signal being reflected by the satellite antenna reflector. Using the geothermal heat source to heat the fluid that heats the satellite antenna reflector provides an environmentally friendly solution to heating the satellite antenna reflector as well.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A satellite antenna heating system, comprising:

a satellite antenna reflector defining a reflector fluid chamber and that includes a reflector wall, wherein the reflector wall includes:

a first surface that is located adjacent the reflector fluid chamber; and a second surface that is located opposite the reflector wall from the first surface and provides an outer surface of the satellite antenna reflector, wherein the reflector fluid chamber is configured to channel a fluid through at least a portion of the satellite antenna reflector.

2. The satellite antenna heating system of claim 1, further comprising:

a fluid moving system that is coupled to the reflector fluid chamber and that is configured to move the fluid through the reflector fluid chamber.

3. The satellite antenna heating system of claim 2, wherein the fluid moving system is configured to begin moving the fluid through the reflector fluid chamber in response to an atmospheric temperature satisfying a predetermined threshold.

4. The satellite antenna heating system of claim 1, wherein the second surface is configured to reflect satellite signals.

5. The satellite antenna heating system of claim 2, further comprising:

a fluid heating system coupled to the fluid moving system, wherein the fluid moving system is configured to move the fluid through the fluid heating system such that fluid output from the fluid heating system has a temperature that is above the freezing point of water.

6. The satellite antenna heating system of claim 5, wherein the fluid heating system includes a geothermal heat exchanger where at least a portion of the geothermal heat exchanger is positioned in a geothermal well that is below a frost line of a subterranean environment to transfer heat from the geothermal well to the fluid.

7. The satellite antenna heating system of claim 1, further comprising:

a plurality of heat transfer members that extend from the reflector wall to provide the first surface of the reflector wall.

8. The satellite antenna heating system of claim 2, wherein the fluid moving system is housed in the satellite antenna reflector.

9. The satellite antenna heating system of claim 1, wherein heat is transferred from the fluid in the reflector fluid chamber to the second surface via the first surface and the reflector wall.

10. The satellite antenna heating system of claim 1, wherein the satellite antenna reflector includes a first satellite antenna reflector panel and a second satellite antenna reflector panel coupled to the first satellite antenna reflector panel, and wherein a first portion of the reflector fluid chamber is included in the first satellite antenna reflector panel and a second portion of the reflector fluid chamber is included in the second satellite antenna reflector panel.

11. The satellite antenna heating system of claim 10, wherein the first portion of the reflector fluid chamber is configured to couple to the second portion of the reflector fluid chamber.

12. The satellite antenna heating system of claim 1, wherein the reflector fluid chamber includes a fluid channel.

13. The satellite antenna heating system of claim 12, wherein the fluid channel is a serpentine fluid channel.

14. A satellite antenna reflector panel, comprising:

a reflector wall that is provided on a satellite antenna reflector panel and that includes:

a first surface that is located adjacent at least a portion of a reflector fluid chamber that is defined by the satellite antenna reflector panel; and a second surface that is located opposite the reflector wall from the first surface and that provides at least a portion of an external surface of the satellite antenna reflector panel, wherein the reflector fluid chamber is configured to channel a fluid through at least a portion of the satellite antenna reflector panel.

15. The satellite antenna reflector panel of claim 14, wherein the reflector fluid chamber is configured to couple to an adjacent reflector fluid chamber of an adjacent satellite antenna reflector that extends from the reflector wall.

16. The satellite antenna reflector panel of claim 14, further comprising:

a fluid moving system coupled to the reflector fluid chamber and configured to move the fluid through the reflector fluid chamber.

17. A method of providing fluid heating to a satellite reflector, comprising:

moving, by a fluid moving system, a fluid through a reflector fluid chamber that is located in a satellite antenna reflector that includes a reflector wall, wherein the reflector wall includes:

a first surface that is located adjacent the reflector fluid chamber; and a second surface that is located opposite the reflector wall from the first surface and provides an outer surface of the satellite antenna reflector; and transferring heat from the fluid in the reflector fluid chamber to the second surface via the first surface and the reflector wall.

18. The method of claim 17, further comprising:

transferring, by a fluid heating system coupled to the fluid moving system, heat to the fluid.

19. The method of claim 18, wherein the fluid heating system includes a geothermal heat exchanger, wherein at least a portion of the geothermal heat exchanger is positioned in a geothermal well that is below a frost line of a subterranean environment to transfer heat from the geothermal well to the fluid.

20. The method of claim 17, further comprising:

reflecting, via the second surface of the reflector wall, satellite signals.

* * * * *